United States Patent [19]

Mangel

[11] 4,108,283

[45] * Aug. 22, 1978

[54] MASTER OPERATOR FOR VERTICALLY MOVING ELEVATOR CAR DOORS

[76] Inventor: Karl Mangel, 850 N. Dewitt Pl., Chicago, Ill. 60611

[ * ] Notice: The portion of the term of this patent subsequent to Apr. 5, 1994, has been disclaimed.

[21] Appl. No.: 761,545

[22] Filed: Jan. 21, 1977

[51] Int. Cl.[2] ..... B66B 13/12

[52] U.S. Cl. ..... 187/52 LC; 49/118; 187/59

[58] Field of Search ..... 187/51, 52 R, 52 LC, 187/58-60; 49/62, 65, 73, 116, 118

[56] References Cited

U.S. PATENT DOCUMENTS

| | | | |
|---|---|---|---|
| 3,783,977 | 1/1974 | Voser | 187/52 LC |
| 3,921,763 | 11/1975 | Westerlund | 187/52 LC |
| 4,015,688 | 4/1977 | Mangel | 187/52 LC |

*Primary Examiner*—John J. Love
*Assistant Examiner*—Jeffrey V. Nase
*Attorney, Agent, or Firm*—Edmond T. Patnaude

[57] ABSTRACT

A master door operator employs gate mounted driving clutch members which are locked in the clutching position by linkage arms, and a plurality of driven clutches are respectively mounted on the landing doors and each includes a rotatable cam carrying a pair of clutch rollers.

10 Claims, 7 Drawing Figures

MASTER OPERATOR FOR VERTICALLY MOVING ELEVATOR CAR DOORS

The present invention relates in general to a new and improved clutch mechanism for use in a master elevator door operator system such as disclosed in my copending application Ser. No. 589,030 filed June 23, 1975 now U.S. Pat. No. 4,015,688. Both the driving and driven clutches of the present invention are improvements over the corresponding clutches disclosed in the said application.

BACKGROUND OF THE INVENTION

In the master door operator with which the present invention finds particular application, a driving clutch mechanism is mounted to the outer face of a vertically movable gate on an elevator car for cooperation with a plurality of driven clutch mechanisms respectively mounted on the inner faces of vertically movable landing doors. When the gate is closed the driving clutch passes freely through the several driven clutches as the elevator car moves from one floor to the next. When, however, the car is at a landing and the gate is lifted, the driving clutch engages the driven clutch on the particular landing door initially to release the interlock on the landing door and then to lift the landing door as the gate is lifted. As the gate is lowered, the landing door is also lowered, and as the driving clutch is released from engagement with the driven clutch the landing door interlock is returned to the interlocked position thereby permitting the car to be moved.

The driving clutch mechanism disclosed in my said copending application employs a pair of springs to hold the driving clutch members in the extended clutching positions. Since some car gates and landing doors are relatively heavy, these springs and the associated hardware also had to be relatively heavy to prevent slippage between the gate and doors.

The driven clutch mechanism disclosed in my said copending application employs a substantial number of linkage arms and associated bearings making it relatively costly to manufacture and maintain.

SUMMARY OF THE INVENTION

Briefly, there is provided in accordance with the present invention a new and improved master door operator employing a driving clutch mechanism having clutch members which are locked in expanded clutching positions and further employing a novel driven clutch and interlock operating mechanism employing a rotatable camming disc having a pair of clutch rollers mounted thereon. Rotation of the driving clutch mechanism as the gate is initially lifted causes the clutch members to move into the expanded positions and to rotate the camming disc to release the interlock. With the driving clutch mechanism disposed beneath one of the driven clutch rollers the lifting of the car gate lifts the landing door. Similarly, as the gate is lowered, the driving clutch mechanism pushes down on the other of the driven clutch rollers to exert a positive closing force on the landing door. During the final angular movement of the driving clutch mechanism into the vertical position, the driven clutch cam is rotated into the interlocked position and then the driving clutches are positively retracted into the declutched positions out of engagement with the cam rollers.

GENERAL DESCRIPTION OF THE DRAWINGS

A better understanding of the present invention may be had by reference to the following detailed description taken in conjunction with the accompanying drawings wherein.

DETAILED DESCRIPTION OF THE INVENTION

Figure 1:
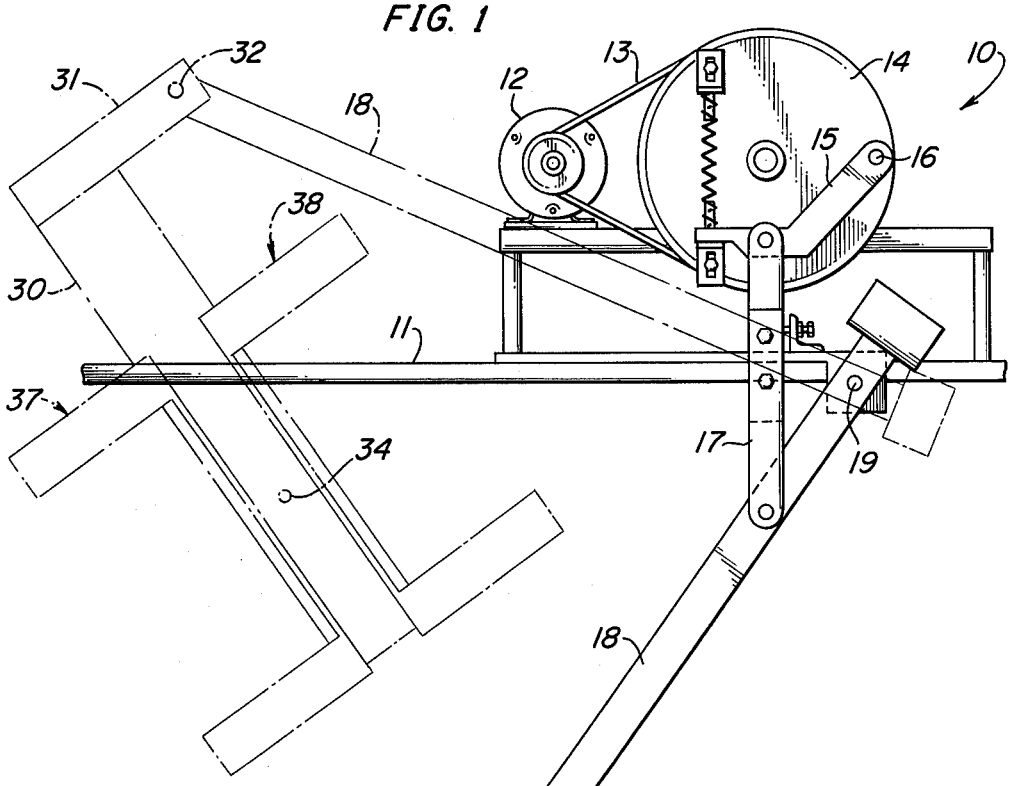
FIG. 1 is a front elevational view of a portion of a master door operator mounted to a freight elevator car, the gate of the car being in the closed position.
Figure 1:
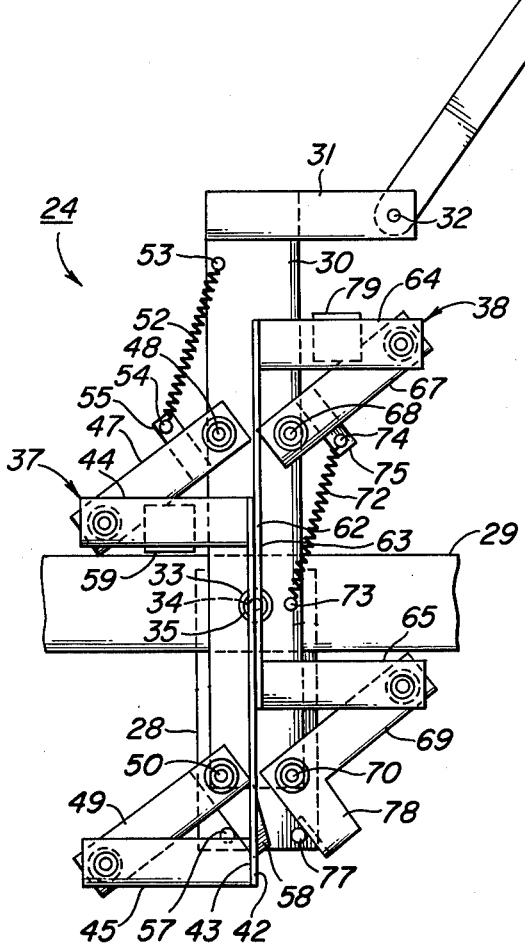

Referring in particular to FIG. 1 of the drawings, a gate operating mechanism 10 is mounted on the roof portion 11 of an elevator car and includes an electric motor 12 connected by a friction belt 13 to a pulley 14. A linkage arm 15 is pivotably mounted by a shaft 16 to the pulley 14, and a second linkage arm 17 is pivotably connected at one end to the arm 15 and at the other end to a lift arm 18. As shown, the arm 18 is pivotably mounted to the car by a shaft 19. Reference is directed to my said copending application for a more detailed description of the gate operating mechanism 10. It will be understood, however, that if desired, the linkage arm 17 may be pivotably mounted directly to the pulley 14 at a point offset from a vertical plane extending through the pivot axis between the arms 17 and 18 when the gate is closed. In which case, manual lifting of the gate is possible because of slippage between the pulley 14 and the belt 13.

As thus far described, it may be seen that rotation of the motor 12 in one direction swings the arm 18 from the lower position illustrated in solid lines wherein the car gate is completely closed to the upper position illustrated in phantom wherein the car gate is fully open. Rotation of the motor in the opposite direction swings the arm 18 down into the lower position wherein the gate is closed.

Figure 4:
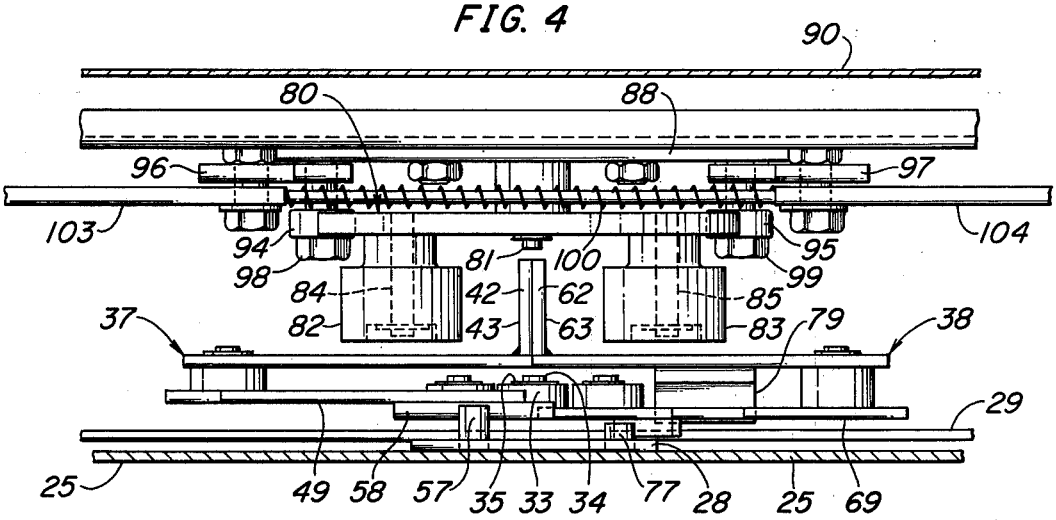
FIG. 4 is a bottom view showing the driving and driven clutch mechanisms in a declutched position.

A driving clutch assembly or mechanism is generally identified by the reference number 24 and is pivotably mounted to the outer face of the gate 25 as shown in FIG. 4. More particularly, a retractor support plate 28 is affixed to the outer face of the gate and is stationary relative to the gate. A horizontally elongated mounting plate 29 extends across the outer face of the plate 28 and is fixedly secured to the gate by means of bolts (not shown). Rotatably mounted to the mounting plate 29 is a clutch base plate 30 having a laterally extending arm 31 at the top. The lower end of the operating arm 18 is pivotably secured by a pin 32 to the arm 31. The base plate 30 is mounted to the mounting plate 29 by a bearing 33 rotatably held on a shaft 34 by a snap ring 35. Accordingly, as the operating arm 18 swings between the lower and upper positions the gate is lifted vertically in its vertical ways and the base plate 30 pivots between the two positions shown respectively in solid and phantom lines in FIG. 1.

Figure 2:
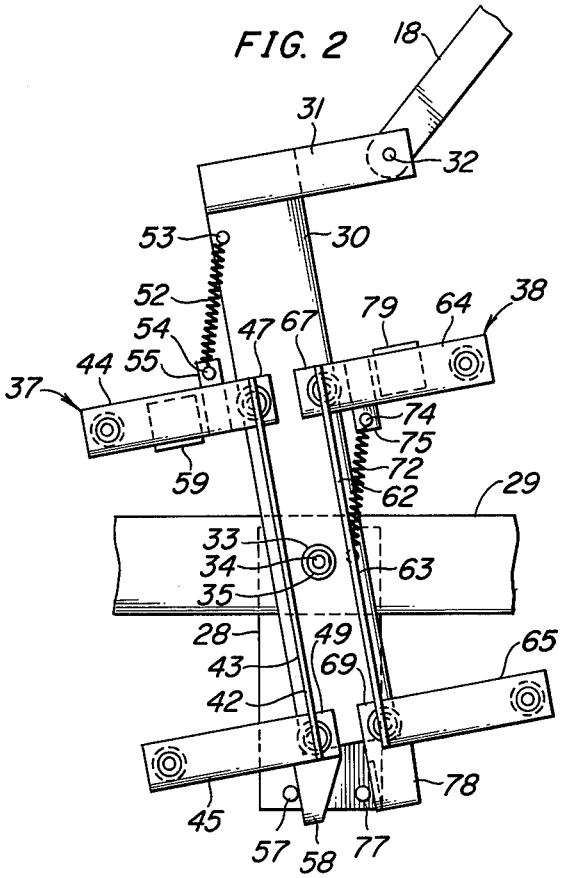
FIG. 2 is a front elevational view of the driving clutch mechanism when the gate is partially open.

A pair of clutch members 37 and 38 are mounted to the clutch base plate 30 for controlled movement between the retracted declutching position shown in FIG. 1 and the extended clutching position shown in FIG. 2. As will become manifest as this description proceeds, the clutch members 37 and 38 are moved from the retracted to the fully extended positions during the initial 10° of swing of the arm 18 and remain in the extended positions until the arm 18 swings back through the final 10° in closing the gate.

The clutch member 37 comprises a plate member 42 having a face 43 which provides the driving clutch surface on the member 37. A pair of mutually parallel laterally extending arms 44 and 45 are fixed as by welding to the top and bottom of the plate member 42. An upper linkage arm 47 is pivotably attached near one end to the arm 44 and near the other end to the base plate 30 for pivotable movement about a pin 48. A lower linkage arm 49 is pivotably attached near one end to the arm 45 and near the other end to the base plate 30 for pivotable movement about a pin 50. A coil spring 52 is stretched between a pin 53 fixed to the plate 30 and a pin 54 on an arm 55 extending from the linkage arm 47. When the base plate 30 is in the vertical position as shown in FIG. 1, upward movement of the clutch member 37 by the spring 52 is prevented by a stop and retractor 57 in the form of a pin extending outwardly from the plate 28 into the path of movement of a leg 58 on the linkage arm 49. However, as the plate 30 rotates counterclockwise during the upward swing of the arm 18, the spring 52 pulls the arm 47 up and thereby lifts the clutch member 37 into the extended position shown in FIG. 2. A stop flange 59 extends rearwardly from the arm 44 to engage the lower edge of the arm 47 to limit upward movement of the clutch member 37 to a position wherein the arms 44, 47 and 45, 49 are in parallel alignment as shown in FIG. 2. When in this position the reaction force exerted on the clutch member 37 by the driven clutch does not tend to move the clutch 37 downwardly into the retracted declutching position.

The clutch member 38 comprises a plate member 62 having a face 63 which provides the driving clutch surface on the member 38. A pair of mutually parallel laterally extending arms 64 and 65 are fixed as by welding to the top and bottom of the plate member 62. An upper linkage arm 67 is pivotably attached near one end to the arm 64 and near the other end to the base plate 30 for pivotable movement about a pin 68. A lower linkage arm 69 is pivotably attached near one end to the arm 65 and near the other end to the base plate 30 for pivotable movement about a pin 70. A coil spring 72 is stretched between a pin 73 fixed to the plate 30 and a pin 74 on an arm 75 extending from the linkage arm 67. When the base plate is in the vertical position as shown in FIG. 1, downward movement of the clutch member 38 by gravity and by the spring 72 is prevented by a stop retractor member 77 in the form of a pin extending outwardly from the plate 28 into the path of movement of a leg 78 on the linkage arm 69. However, as the plate 30 rotates counterclockwise during the swing of the arm 18, the spring 72 pulls the arm 67 down and together with gravity lowers the clutch member 38 into the extended position shown in FIG. 2. A stop flange 79 extends rearwardly from the arm 64 to engage the upper edge of the arm 67 to limit downward movement of the clutch member 38 to a position wherein the arms 64, 67 and 65, 69 are in parallel alignment as shown in FIG. 2. When in this position the reaction force exerted on the clutch member 38 by the driven clutch is taken up directly by the arms 67 and 64 including the stop 79 and does not therefore move the clutch 38 upwardly into a retracted, declutching position.

Figure 3:
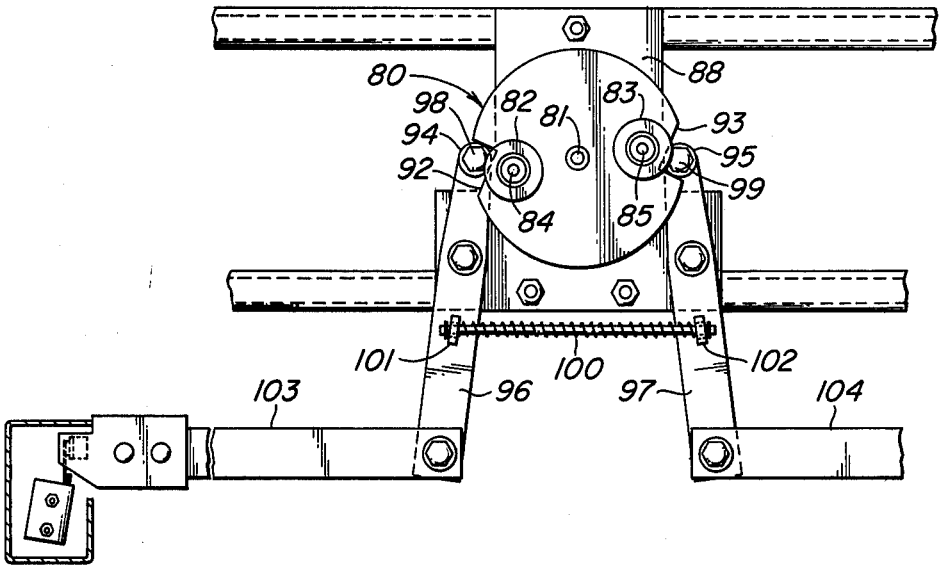
FIG. 3 is an elevational view of a driven clutch mechanism mounted to the inside of a landing door.

Referring to FIG. 3 there is shown one of the plurality of identical driven clutch mechanisms which are respectively mounted to the inner faces of the landing doors. Each driven clutch mechanism comprises a circular plate 80 journaled to the associated landing door for rotation about a shaft 81. The axis of the shaft 81 is aligned with the axis of the shaft 34 when the car is at the associated landing and the gate and door are both closed. A pair of rollers 82 and 83 are rotatably mounted to the plate 80 on shafts 84 and 85 which are disposed on a line extending through the axis of the shaft 81. Theoretically, the distance between the rollers 82 and 83 should be equal to the distance between the clutch surfaces 43 and 63 when the clutches 37 and 38 are fully extended. However, to prevent binding of the clutches when the shafts 34 and 81 are not precisely aligned when the gate begins to move up, the distance between the rollers 82 and 83 should be slightly greater than the distance between the surfaces 43 and 63 when the clutches 37 and 38 are fully extended. As shown in FIG. 4, the shaft 81 is mounted to a mounting plate 88 which is in turn fixedly mounted to the landing door 90.

The plate 80 is circular, and a pair of camming notches 92 and 93 are provided at diametrically opposite locations in the edge thereof. A pair of cam follower rollers 94 and 95 are carried near the respective upper ends of arms 96 and 97 which are pivotably mounted to the plate 88 by bolts 98 and 99. A coil spring 100 compressed between lugs 101 and 102 on the arms 96 and 97 urges the rollers 94 and 95 against the edge of the cam plate 80 and thus into the notches 92 and 93 when the notches are aligned with the rollers. Interlock bars 103 and 104 are pivotably attached near the bottom of the arms 96 and 97. The outer ends of the bars are used to mechanically interlock the landing doors in the closed position when the rollers are at home in the camming notches and the bars are in the outward positions as shown in FIG. 3.

OPERATION

Figure 5A:
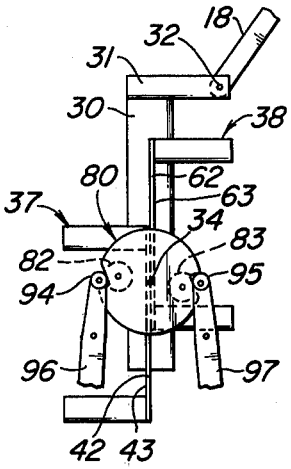
FIGS. 5A, 5B and 5C are schematic views showing the driving and driven clutches in three different operating positions.
Figure 5B:
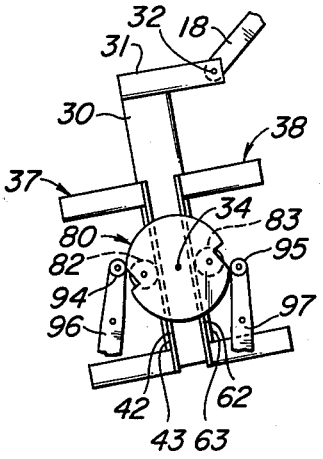
Figure 5C:
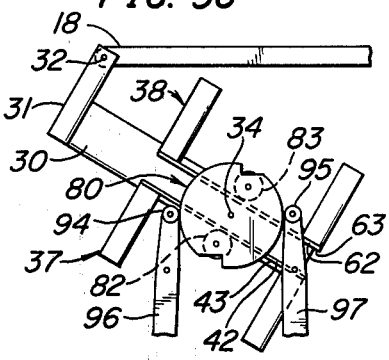

Reference is made to FIGS. 5A, 5B and 5C, which are somewhat schematic illustrations of the driving and driven clutch mechanisms in different operating positions, in order to facilitate a better understanding of the operation of the master door operator of the present invention.

In FIG. 5A the clutch mechanisms are shown in the respective positions which they occupy when the gate is closed and the car is at a landing. The driving clutch members 37 and 38 are retracted wherefor the flanges 42 and 62 are in mutual abutment, and plate 30 is in a vertical position. The pivot axes of the plate 30 and the plate 80 are aligned and the cam rollers 94 and 95 are in the camming notches wherefor the interlock bars 103 and 104, FIG. 3, are in the extended interlocking positions.

As the gate is lifted the arm 18 swings clockwise causing the gate to move up and the plate 30 to pivot counterlockwise. During the initial movement of the plate 30, the legs 58 and 78 move away from the retractor pins 57 and 77 (FIG. 1) wherefor the clutch 37 may be elevated by the spring 52 and the clutch 38 may be moved down by gravity and the spring 72. When the plate 30 has pivoted through about ten degrees the clutch members 37 and 38 have moved outwardly against the driven clutch rollers 82 and 83 and have thereby rotated the plate 80 counterclockwise a sufficient amount to cam the rollers 94 and 95 out of the notches 92 and 93 thereby to release the interlock. The diameter of the plate 80 on which the rollers 82 and 83 are pivoted now extends perpendicularly to the planes of the driving clutch surfaces on the flanges 42 and 62 and will remain in that position throughout the remainder of the lifting operation.

As the arm 18 continues to swing up in a clockwise direction the plate 30 is pivoted counterclockwise until the arm 18 is horizontal as shown in FIG. 5C. During this time the flange 62 is bearing against the roller 83 whereby the landing door is lifted in substantial unison with the gate. Continued swinging of the arm 18 to the position shown in phantom in FIG. 1 continues to lift both the gate and the landing door to the fully open positions.

In order to close the gate and the associated landing door, the arm 18 is swung in a counterclockwise direction down to the position shown in FIG. 5A. Initially, the plate 30 pivots counterclockwise until the arm 18 reaches the horizontal position shown in FIG. 5C. Thereafter the plate 30 pivots clockwise through the position shown in FIG. 5B to the final, closed position shown in FIG. 5A. As the plate 30 pivots through the final ten degrees from the position shown in FIG. 5B to that shown in FIG. 5A the legs 58 and 78 abut against the retractor pins 57 and 77 which positively retract the clutch members 37 and 38 away from the rollers 82 and 83. Inasmuch as the caming notches are at that time opposite the cam rollers 94 and 95, the spring 100 (FIG. 3) pushes the rollers 94 and 95 into the bottoms of the notches thereby completing the rotation of the plate 80 to the closed position as shown in FIG. 5A. During this final movement of the plate 80 the interlock bars 103 and 104 are projected into the interlock positions wherein the associated landing door is electrically and mechanically prevented from opening in the manner described in my said copending application.

While the present invention has been described in connection with a particular embodiment thereof, it will be understood by those skilled in art that many changes and modifications may be made without departing from the true spirit and scope of the present invention. Therefore, it is intended by the appended claims to cover all such changes and modifications which come within the true spirit and scope of this invention.

What is claimed:

1. In an elevator system including an elevator car having a vertically movable gate and a plurality of vertically movable landing doors respectively located at a plurality of landings, comprising a plurality of driven clutch members rotatably mounted to respective ones of said landing doors, a driving clutch means mounted to said gate for selectively engaging said clutch members to open the one of said doors disposed opposite said gate when said gate is opened, said driving clutch means including a base member mounted to said gate for limited rotational movement about a horizontal axis, and first and second clutch members each having rectilinear clutch surfaces, first and second pluralities of mutually parallel linkage arms pivotably mounted to said base and clutch members for controlling the movement of said clutch members between retracted declutching positions and extended clutching positions, said linkage arms extending perpendicularly to said clutch surfaces when said clutch members are in said extended clutching positions, and means for rotating said base member in response to opening and closing movements of said gate.

2. The combination set forth in claim 1 comprising a plurality of stop and retractor means carried by said base member for engaging ones of said linkage arms to retract said clutch members into the declutching position as said base member is rotated into the position occupied thereby when said gate is closed.

3. The combination set forth in claim 2 comprising interengaging stop surfaces on said clutch members and said linkage arms for preventing the movement of said linkage arms beyond an over center position.

4. The combination according to claim 1 wherein said driven clutch means each comprise a generally circular plate mounted to the associated landing door for rotation about a horizontal axis, and a pair of rollers mounted to said plate for rotation on respective horizontal axis lying on a diameter of said plate.

5. The combination according to claim 4 wherein the spacing between the adjacent surfaces of said rollers is greater than the spacing between said clutch surfaces when said clutch members are in said extended positions.

6. The combination according to claim 5 comprising reciprocable interlock means carried by said landing doors, at least one camming surface on said plate, and follower means carried by said interlock means and held against said camming surface for unlocking said interlock means in response to rotation of said plate.

7. The combination according to claim 6 wherein said camming surface comprises the peripheral edge of said plate.

8. The combination according to claim 7 comprising a pair of diametrically opposed notches in said peripheral edge, and said follower means comprises a pair of rollers resiliently biased against said edge.

9. The combination according to claim 1 wherein each of said driven clutch members comprises a base member rotatably mounted to the respective landing door, and a plurality of rollers rotatably mounted to said base member on opposite sides of the axis of rotation of said base member, the axes of rotation of said rollers being parallel to the axis of rotation of said base member.

10. In an elevator system including an elevator car having a vertically movable gate and a plurality of vertically movable landing doors respectively located at a plurality of landings, comprising a driving clutch means rotatably mounted to said gate and having clutch surfaces movable between retracted declutching positions and extended clutching positions, a plurality of driven clutch members respectively mounted to said landing doors for selected engagement by said driven clutch means to open the door disposed opposite said elevator car when said gate is opened, each of said driven clutch members comprising a base member rotatably mounted to the respective landing door, and a plurality of rollers rotatably mounted to said base member on opposite sides of the axis of rotation of said base member, the axes of rotation of said rollers being parallel to the axis of rotation of said base member.

* * * * *